US005582352A

United States Patent [19]

Bokström

[11] Patent Number: 5,582,352

[45] Date of Patent: Dec. 10, 1996

[54] METHOD OF PREPARING CHEMI-MECHANICAL PULP

[75] Inventor: Monica Bokström, Kista, Sweden

[73] Assignee: AGA Aktiebolag, Lidingo, Sweden

[21] Appl. No.: 362,579

[22] PCT Filed: Feb. 1, 1994

[86] PCT No.: PCT/SE94/00074

§ 371 Date: Mar. 7, 1995

§ 102(e) Date: Mar. 7, 1995

[87] PCT Pub. No.: WO94/18383

PCT Pub. Date: Aug. 18, 1994

[30] Foreign Application Priority Data

Feb. 9, 1993 [SE] Sweden ..... 9300409

[51] Int. Cl.[6] ..... B02C 7/00

[52] U.S. Cl. ..... 241/21; 241/28

[58] Field of Search ..... 241/21, 24, 28, 241/246

[56] References Cited

U.S. PATENT DOCUMENTS

| | | | |
|---|---|---|---|
| 4,059,237 | 11/1977 | Mannstrom | 241/246 |
| 4,324,612 | 4/1982 | Lindahl | 162/23 |
| 4,534,397 | 8/1985 | Norrström et al. | 162/23 |
| 4,562,969 | 1/1986 | Lindahl | 241/21 |
| 4,578,147 | 3/1986 | Lindahl et al. | 241/21 X |

*Primary Examiner*—John M. Husar

*Attorney, Agent, or Firm*—Pollock, Vande Sande & Priddy

[57] ABSTRACT

A method of producing chemimechanical pulp, comprises the steps of grinding wood in a grinding mill housed in a grinding chamber, maintaining the chamber at an overpressure, spraying water onto the wood, and supplying oxygen and/or hydrogen peroxide via the spray water to the grinding chamber.

20 Claims, 1 Drawing Sheet

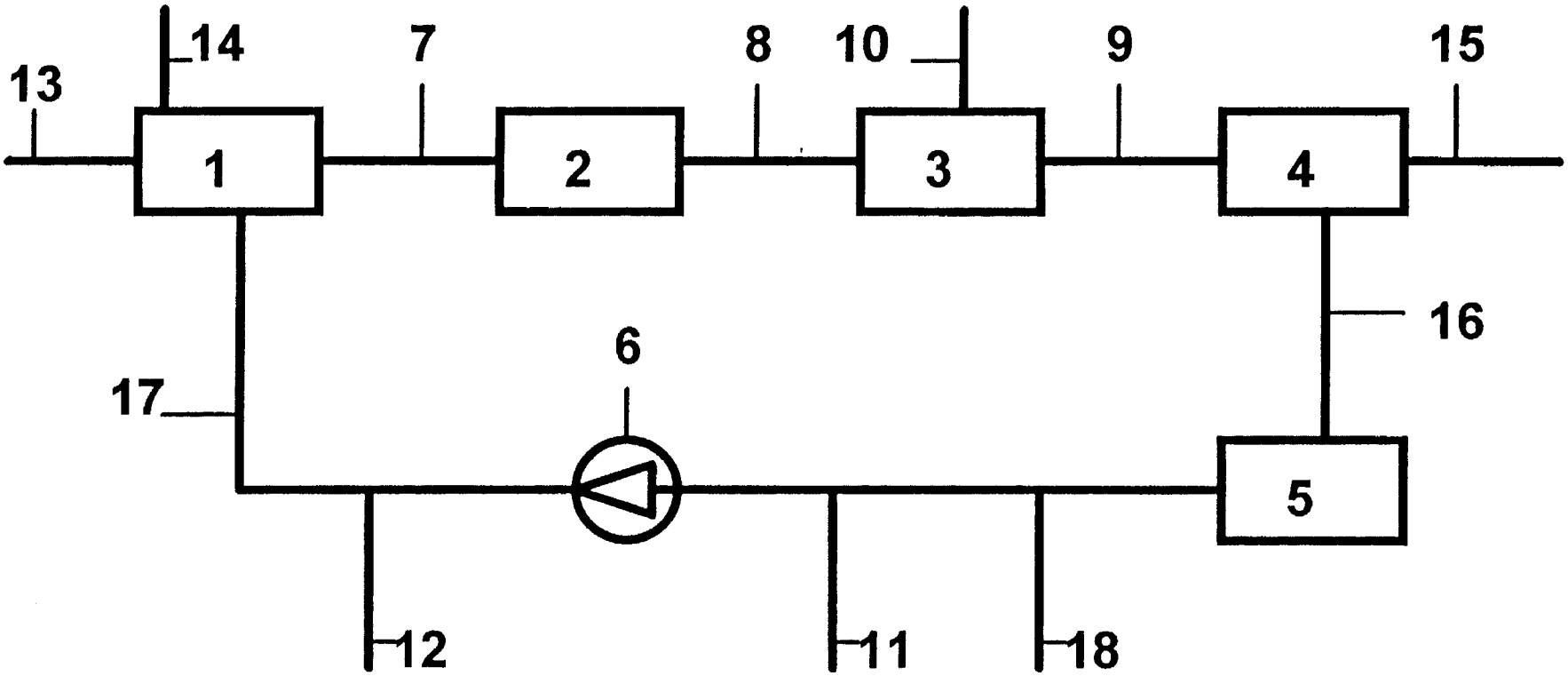
13
14
1
7
2
8
10
3
9
4
15
16
5
17
6
12
11
18

METHOD OF PREPARING CHEMI-MECHANICAL PULP

FIELD OF THE INVENTION

The present invention relates to a method for manufacturing chemimechanical pulp in which wood material is ground with the aid of a grinder in a grinding chamber, and in which the chamber is maintained at an overpressure and water is sprayed onto the wood.

BACKGROUND OF THE INVENTION

One method of producing mechanical pulp comprises grinding wood in a grinding mill. The wood is treated with hot water in a pressurized grinding chamber, with the intention of producing a higher quality pulp, the chamber also being maintained at a high temperature. The properties concerned include brightness, tensile index, tear index and opacity, among others. Hydrogen peroxide has also been added with a stabilizer.

SUMMARY OF THE INVENTION

These measures have resulted in a pulp having satisfactory properties and produced at a competitive cost. However, it is desired to improve ground mechanical or chemimechanical pulp still further.

Accordingly, an object of the present invention is to produce a chemimechanical pulp which has improved properties.

By improved properties it is meant in the present document an improvement in the "sum" of the properties of the pulp. Thus, one property may be impaired while the other properties are improved when taken together.

This object is achieved in accordance with the present invention by means of a method for producing chemimechanical pulp in which wood is ground in a grinding mill in a grinding chamber, and the chamber is maintained at an overpressure and water is sprayed onto the wood. The method is characterized by supplying oxygen via the spray water to the chamber.

It has surprisingly been found that the properties of pulp produced in a pressurized grinding mill at elevated temperatures are improved when oxygen is supplied to the grinding chamber. The oxygen is supplied to the chamber of the grinding mill dissolved in, or otherwise being part of, the spray water. For example, a part of the oxygen can be present in when alkaline spray water is used.

It has also been found particularly advantageous to combine the oxygen charge with a hydrogen peroxide charge.

Further advantages are gained when the water is alkaline.

BRIEF DESCRIPTION OF THE DRAWING

The invention will now be described in more detail with reference to an exemplifying embodiment thereof and also with reference to the accompanying drawing, the single FIGURE of which is a schematic illustration of equipment used to produce ground pulp.

DESCRIPTION OF THE PREFERRED EMBODIMENT(S)

Wood is charged through a shaft 14 to a grinding mill 1 mounted in a pressurized grinding chamber. The necessary infeed valve has not been shown. The ground material defibered in the grinding mill is then passed to a shredder 2 through a conduit 7. The pulp is taken from the shredder and passed through conduit 8 to a cyclone 3, in which the pulp is separated from the gas, so that the pulp removed from the cyclone is under atmospheric pressure. The gas exists through conduit 10 pulp taken from the cyclone 3 is passed through a conduit 9 to a disc filter 4, in which the pulp is de-watered and passed from the filter through a conduit 15 for further treatment.

The filtrate obtained in the filter 4 is collected in a tank 5 through conduit 16 and is passed from the tank to the grinding mill 1 through a conduit 17 and with the aid of a pump 6. Water is added to the system through the conduit 17, via a further conduit 18, so as to compensate for the water that accompanies the pulp from the disc filter.

According to an embodiment of the invention, oxygen is added to the spray water in the conduit 17 downstream of the pump 6, through a conduit 12. The oxygen supplied constitutes at most 5 percent by weight, preferably 0.2 to 2 percent by weight calculated on dry ground pulp.

The properties of the pulp are further improved when hydrogen peroxide is added in the aforesaid embodiment. This peroxide addition may be effected through a conduit 11 between the filter tank 5 and the pump 6 into the conduit 17. The peroxide content of the water is at most 4 percent by weight, preferably between 0.5 to 2 percent by weight calculated on ground pulp.

The following Table shows the results obtained from tests.

TABLE

| | Nitrogen | Air | 1% $H_2O_2$ ($H_2$) | 1% $H_2O_2$ 1.5% $O_2$ (in air) | 0.5% $H_2O_2$ 1.5% $O_2$ (in air) |
|---|---|---|---|---|---|
| Brightness | 61.1 | 65.0 | 67.0 | 68.5 | 63.4 |
| Tensile index | 10.9 | 13.3 | 16.0 | 18.2 | 19.7 |
| Tear index | 2.2 | 2.4 | 2.5 | 2.9 | 3.0 |
| Opacity | 96.5 | 95.2 | 95.3 | 94.9 | 95.0 |

The first column of the Table defines a number of properties. The second column discloses the values obtained in respect of the properties listed in column B when carrying out the test under a pressure of 4.5 bars in a pure nitrogen atmosphere. Column B discloses the values obtained in corresponding tests as in column B, but while using air instead of nitrogen. No chemical additions were made during these tests. The water supplied to the system had a pH of about 7. A comparison between the values contained in columns B and B shows that the oxygen content of the air has a substantial influence on the properties of the pulp.

The values given in column B were obtained by adding 1 percent by weight hydrogen peroxide. The chamber was pressurized to 4.5 bars with nitrogen. The water had a pH of about 11.5. A hydrogen peroxide stabilizer was also supplied to the system. The tests show that hydrogen peroxide has a great influence on the pulp properties.

The first tests carried out in accordance with the invention and listed in column B were carried out at a pressure of 4.5 bars. The spray water contained 1.5 percent oxygen, 1 percent hydrogen peroxide and stabilizer. The water had a pH of 11.5. The grinding chamber was pressurized with air. These tests illustrate the synergistic effect of oxygen and hydrogen peroxide.

The last column of the Table illustrates the same tests as those in the preceding column, but with the difference that the hydrogen peroxide concentration was halved.

All pressures recited relate to overpressures.

What is claimed is:

1. A method of producing chemimechanical pulp, comprising the steps of:

grinding wood in a grinding mill housed in a grinding chamber, maintaining the chamber at an overpressure, spraying water onto the wood, and supplying oxygen via the spray water to the grinding chamber.

2. A method according to claim 1, further comprising the step of adding hydrogen peroxide to the spray water.

3. A method according to claim 2 wherein the pH of the spray water is within the range of 5 to 12.

4. A method according to claim 3 wherein the hydrogen peroxide content of the spray water is at most 4 percent by weight, calculated on dry pulp.

5. A method according to claim 3 wherein the hydrogen peroxide content of the spray water is within the range of 0.5 to 2 percent by weight, calculated on dry pulp.

6. A method according to claim 2 wherein the hydrogen peroxide content of the spray water is at most 4 percent by weight, calculated on dry pulp.

7. A method according to claim 2, wherein the oxygen content is at most 5 percent by weight.

8. A method according to claim 2, wherein the oxygen content is within the range of 0.2 to 2 percent by weight.

9. A method according to claim 2 wherein the pH of the spray water is within the range of 9 to 11.

10. A method according to claim 2 wherein the hydrogen peroxide content of the spray water is within the range of 0.5 to 2 percent by weight, calculated on dry pulp.

11. A method according to claim 1, wherein the oxygen content is at most 5 percent by weight, calculated on ground pulp.

12. A method according to claim 11 wherein the pH of the spray water is within the range of 5 to 12.

13. A method according to claim 11 wherein the pH of the spray water is within the range of 9 to 11.

14. A method according to claim 11 wherein the hydrogen peroxide content of the spray water is at most 4 percent by weight, calculated on dry pulp.

15. A method according to claim 11 wherein the hydrogen peroxide content of the spray water is within the range of 0.5 to 2 percent by weight, calculated on dry pulp.

16. A method according to claim 1 wherein the pressure exceeds 2 bars.

17. A method according to claim 1, wherein the pressure exceeds 4 bars.

18. A method according to claim 1, wherein the oxygen content is within the range of 0.2 to 2 percent by weight.

19. A method according to claim 1 wherein the pH of the spray water is within the range of 5 to 12.

20. A method according to claim 1 wherein the pH of the spray water is within the range of 9 to 11.

* * * * *